US007303375B2

(12) United States Patent
Cunha et al.

(10) Patent No.: US 7,303,375 B2
(45) Date of Patent: Dec. 4, 2007

(54) REFRACTORY METAL CORE COOLING TECHNOLOGIES FOR CURVED LEADING EDGE SLOTS

(75) Inventors: Frank Cunha, Avon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 53 days.

(21) Appl. No.: 11/286,942

(22) Filed: Nov. 23, 2005

(65) Prior Publication Data

US 2007/0116566 A1 May 24, 2007

(51) Int. Cl.
*F01D 5/18* (2006.01)

(52) U.S. Cl. ..... 416/90 R; 416/97 R; 29/889.721

(58) Field of Classification Search ..... 416/90 R, 416/97 R; 29/889.721
See application file for complete search history.

(56) References Cited

U.S. PATENT DOCUMENTS

| | | | | |
|---|---|---|---|---|
| 5,486,093 | A * | 1/1996 | Auxier et al. | 416/97 R |
| 5,637,239 | A * | 6/1997 | Adamski et al. | 29/889.721 |
| 2003/0143075 | A1 * | 7/2003 | Fleck | 29/889.721 |

FOREIGN PATENT DOCUMENTS

| | | |
|---|---|---|
| EP | 0614917 | 3/1995 |
| EP | 1013877 | 6/2000 |
| EP | 1467064 | 10/2004 |

* cited by examiner

*Primary Examiner*—Richard A. Edgar
(74) *Attorney, Agent, or Firm*—Bachman & LaPointe

(57) ABSTRACT

A turbine engine component has an airfoil portion with a leading edge portion. The leading edge portion includes a plurality of staggered holes for causing fluid to flow over a surface of the airfoil portion. A method for forming the leading edge portion using refractory metal core technology is described.

10 Claims, 1 Drawing Sheet

REFRACTORY METAL CORE COOLING TECHNOLOGIES FOR CURVED LEADING EDGE SLOTS

BACKGROUND OF THE INVENTION (1) Field of the Invention

The present invention relates to a process for forming leading edge portion of an airfoil portion of a turbine engine component and a turbine engine component formed thereby.

(2) Prior Art

Airfoil leading edge cooling is critical as there are considerable amounts of oxidation distress observed in almost all operating airfoil portions of turbine engine components. While leading edge cooling is known in the art, a better leading edge cooling scheme is desirable—particularly one which reduces the amount of distress seen in the operating airfoil portions.

SUMMARY OF THE INVENTION

In accordance with the present invention, a leading edge portion for an airfoil portion of a turbine engine component is provided. The leading edge portion broadly comprises a plurality of staggered holes for causing a film of cooling fluid to flow over a surface of the airfoil portion.

Further in accordance with the present invention, a process for fabricating a cooling system in a leading edge portion of an airfoil portion of a turbine engine component is provided. The process broadly comprises the steps of providing a die in the shape of an airfoil portion to be formed, inserting at least one ceramic core into the die to form at least one central core element, inserting a refractory metal core sheet having a plurality of curved finger portions into the die, introducing molten metal into the die to form the airfoil portion, and removing the at least one ceramic core and the refractory metal core sheet to form a plurality of staggered holes in the leading edge portion, a plurality of curved passageways associated with the holes, and a central core element communicating with the plurality of curved passageways.

Still further in accordance with the present invention, a turbine engine component is provided. The turbine engine component broadly comprises an airfoil portion having a leading edge portion. The leading edge portion comprises a plurality of staggered holes for causing fluid to flow over a surface of the airfoil portion.

Other details of the refractory metal core cooling technologies for curved leading edge slots of the present invention, as well as other objects and advantages attendant thereto, are set forth in the following detailed descriptions and the accompanying drawings wherein like reference numerals depict like elements.

DETAILED DESCRIPTION OF THE PREFERRED EMBODIMENT(S)

Figure 1:
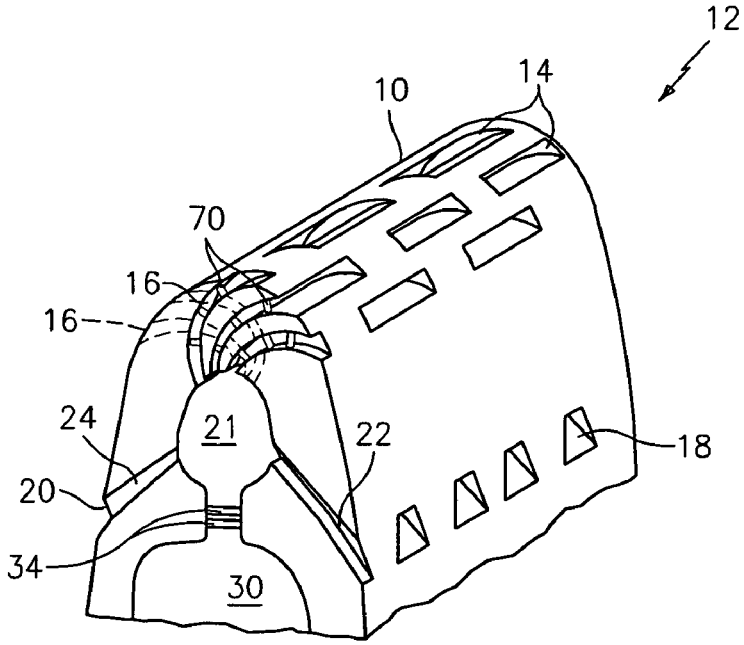
FIG. 1 illustrates an airfoil portion of a turbine engine component having leading edge slots in accordance with the present invention.

Referring now to the FIG. 1 of the drawings, there is illustrated a leading edge portion 10 of an airfoil portion 12 of a turbine engine component, such as a turbine blade, a turbine vane, and a seal. As can be seen from FIG. 1, the leading edge portion 10 preferably has a staggered arrangement of leading edge slots 14 with the slots preferably being arranged in a plurality of rows. While FIG. 1 shows slots as being present on the suction side of the leading edge, similarly arranged slots may be present on the pressure side of the leading edge. Each of the leading edge slots 14 communicates with a source of a cooling fluid, such as turbine engine bleed air, via a central core element 21 and a plurality of curved passageways 16 which communicate with the central core element 21 so as to provide a film of cooling fluid over the external surfaces of the airfoil portion 12. As can be seen from FIG. 1, the curved fluid passageways 16 may extend in a plurality of directions.

If desired, the leading edge portion 10 of the airfoil portion 12 may also include a plurality of shaped suction side film holes 18 and a plurality of shaped pressure side film holes 20. For example, each of the holes 18 and 20 may be shaped to have a trapezoidal configuration. Each of the shaped suction side holes 18 may communicate with a source (not shown) of a cooling fluid via the central core element 21 via a passageway 22. Similarly, each of the shaped pressure side holes 20 may communicate with a source (not shown) of a cooling fluid via the central core element 21 and a passageway 24.

Still further, one or more cross-over holes 34 may be incorporated into the leading edge portion.

Figure 2:
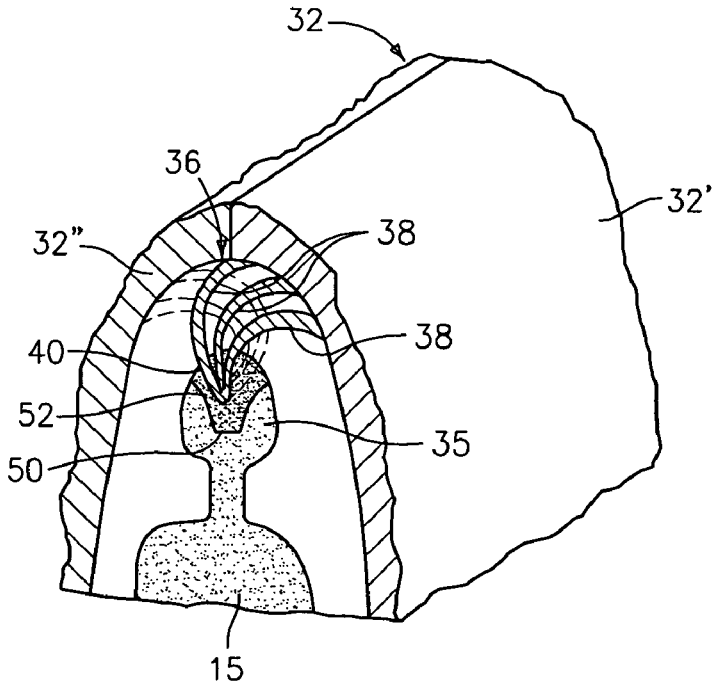
FIG. 2 illustrates a process for forming the leading edge slots of FIG. 1.

Referring now to FIG. 2, there is shown a process for forming the leading edge portion 10 of the turbine engine component with the leading edge slots 14. A silica or alumina core material 35 may be used to form the central core elements 21, a second central core element 30 and cross over holes 34. The silica or alumina core material 35 is placed within a die 32 which may consists of a plurality of die parts such as halves 32' and 32".

A refractory metal core sheet 36 is preferably used to form the leading edge slots 14 and the curved passageways 16. The refractory metal core sheet 36 may be formed from any suitable refractory metal or refractory metal alloy known in the art. For example, the refractory metal core sheet 36 may be formed from molybdenum or a molybdenum based alloy. As used herein, the term "molybdenum based alloy" refers to an alloy containing more than 50 wt % molybdenum.

The refractory metal core sheet 36 includes curved finger portions 38 to form the leading edge slots 14 and the curved passageways 16. The curved finger portions 38 may be curved in two different directions. By doing this, it is possible to form an arrangement of staggered leading edge slots 14 on both a suction side and a pressure side of the leading edge. The base portion 40 of the finger portions 38 is preferably embedded in a binding system used with a freeze casting ceramic slurry. The binding system may comprise any suitable binding system known in the art.

The leading edge portion 10 of the airfoil portion may be formed along with the other regions (not shown) of the airfoil portion such as the pressure and suction sides of the airfoil portion and the trailing edge as well as other portions of the turbine engine component such as an attachment portion (not shown) and a platform (not shown). The other regions, as well as the other portions, have not been shown for the sake of convenience.

To form the leading edge portion 10, one or more silica or alumina cores 15 may be placed in a die 32 to form the central core elements 21 and 30. The refractory metal core sheet 36 with the refractory metal core finger portions 38 are also placed in the die 32. As noted above, the tip portions of the finger portions 38 are preferably placed in a binding system 52 of a freeze-casting ceramic slurry. This is advantageous in terms of integrating the refractory metal core sheet 36 into the core 15. For example, the leading edge refractory metal core fingers portions 38 can be assembled together in a ceramic slurry which binds by the process of sintering through freezing. A slip joint 50 may formed between the core 15 and the freeze casting slurry 52 by using a fugitive coating. The slip joint 50 allows for movement of the mating faces during casting to prevent attached material from cracking. The fugitive coating is a coating with properties (viscosity) that allows for movement of mating parts in a slip joint. Thereafter, molten metal is introduced into the die 32 to form the leading edge portion 10. After the molten metal has solidified and the leading edge portion 10 has been formed, the core 15 and the refractory metal sheet 36 including the refractory metal core finger portions 38 are removed. The core and the refractory metal core sheet may be removed using any suitable technique known in the art. Similarly, the binding system and the slip joint are removed—again, using any suitable technique known in the art.

The shaped holes 18 and 20 and the passageways 22 and 24 may be formed using any suitable technique known in the art. For example, the holes 18 and 20 and the passageways 22 and 24 may be machined using an electrode after the leading edge portion 10 has been cast and formed and the core 15 and the refractory metal core sheet 36 have been removed.

If desired, the curved passageways 16 may be provided with internal features 70, such as rounded pedestals, to improve the heat transfer ability of the passageways 16. The internal features 70 may be formed using any suitable technique known in the art. For example, the internal features may be formed using the refractory metal core technology or may be formed using appropriate machining of the cast material.

Using the refractory metal core technology described herein, the refractory metal core sheet functions as a core which preserves high strength at room temperature. This is important when machining and forming processes are used to introduce cooling features such as the rounded pedestals. Handling of thin refractory metal core sheets is considerably improved over the handling of extremely brittle silica or alumina cores during the assembly of the wax patterns in the casting.

The improvements of the process of the present invention can be summarized as follows. First, the cooling leading edge slots 14 may be moved closer to the leading edge. This reduction in average conduction length from the leading edge improves convective efficiency. Second, higher coolant heat transfer coefficients improve the heat sink capacity of the circuits. Third, the film coverage in a staggered arrangement is maximized leading to improved film effectiveness. In addition, the refractory metal core sheet allows for laying out a film adjacent to the turbine engine component surface.

While the present invention has been described in the context of using a single refractory metal core sheet to form the leading edge slots 14, more than one refractory metal core sheet may be used if desired.

It is apparent that there has been provided in accordance with the present invention refractory metal core technologies for curved leading edge slots which fully satisfies the objects, means, and advantages set forth hereinbefore. While the present invention has been described in the context of specific embodiments thereof, other unforeseeable alternatives, modifications, and variations will become apparent to those skilled in the art having read the foregoing description. Accordingly, it is intended to embrace those unforeseeable alternatives, modifications, and variations which fall within the broad scope of the appended claims.

What is claimed is:

1. A process for fabricating a cooling system in a leading edge portion of an airfoil portion of a turbine engine component, said process comprising the steps of:

providing a die in the shape of an airfoil portion to be formed;

inserting at least one ceramic core into said die to form at least one central core element;

inserting a refractory metal sheet having a plurality of curved finger portions into said die;

introducing molten metal into said die to form said airfoil portion; and removing said at least one ceramic core and said refractory metal sheet to form a plurality of staggered holes in said leading edge portion, a plurality of curved passageways associated with said holes, and a central core element communicating with said plurality of curved passageways.

2. A process according to claim 1, further comprising placing tip portions of said curved finger portions into a binding system from a freeze-casting ceramic slurry.

3. A process according to claim 2, further comprising forming a slip joint between said at least one ceramic core and said binding system.

4. A process according to claim 1, further comprising forming a plurality of shaped cooling slots into a suction side surface of said airfoil portion.

5. A process according to claim 4, further comprising forming a plurality of passageways to form a fluid communication between said cooling slots and a central core element.

6. A process according to claim 1, further comprising forming a plurality of shaped cooling slots into a pressure side surface of said airfoil portion.

7. A process according to claim 6, further comprising forming a plurality of passageways to form a fluid communication between said cooling slots and a central core element.

8. A process according to claim 1, wherein said refractory metal core sheet inserting step comprises inserting a refractory metal core sheet having a plurality of fingers curved in a first direction.

9. A process according to claim 1, wherein said refractory metal core sheet inserting step comprises inserting a refractory metal core sheet having a plurality of fingers curved in more than one direction.

10. A process according to claim 1, wherein said refractory metal core sheet inserting step comprises inserting a refractory metal core sheet formed from a material selected from the group consisting of molybdenum and a molybdenum based alloy.

* * * * *